US005487427A

United States Patent [19]

Curington

[11] Patent Number: 5,487,427

[45] Date of Patent: Jan. 30, 1996

[54] SLIP RELEASE MECHANISM

[75] Inventor: Alfred R. Curington, The Woodlands, Tex.

[73] Assignee: Baker Hughes Incorporated, Houston, Tex.

[21] Appl. No.: 223,597

[22] Filed: Apr. 6, 1994

[51] Int. Cl.[6] ..... E21B 23/00; E21B 23/06; E21B 33/129

[52] U.S. Cl. ..... 166/382; 166/217; 166/387

[58] Field of Search ..... 166/217, 216, 166/215, 209, 137, 134, 123, 138, 382

[56] References Cited

U.S. PATENT DOCUMENTS

| | | | |
|---|---|---|---|
| 3,024,845 | 3/1962 | Conrad | 166/123 |
| 3,519,074 | 7/1970 | Berryman | 166/217 X |
| 4,711,326 | 12/1987 | Baugh et al. | 166/212 X |
| 5,044,433 | 9/1991 | Rubbo et al. | 166/120 |
| 5,044,441 | 9/1991 | Rubbo et al. | 166/382 |

*Primary Examiner*—Stephen J. Novosad
*Attorney, Agent, or Firm*—Rosenblatt & Redano

[57] ABSTRACT

A slip release system is disclosed which undermines support for slips by virtue of selective weakening of a structural element supporting the slips in a set position.

20 Claims, 3 Drawing Sheets

SLIP RELEASE MECHANISM

FIELD OF THE INVENTION

The field of this invention relates to slip systems and an apparatus and method for release of such slips, particularly when used with retrievable packers.

BACKGROUND OF THE INVENTION

In the past, retrievable packers have been designed with opposing slips above and below the packing element. This provides a means for transferring packing element loads due to differential pressure directly through the slips and into the casing without applying this load as a high-tensile load on the mandrel or other parts. This feature has proven to be very desirable for high-performance packers. One feature of such designs, however, is the tendency of the pack-off force applied to the packing element to be "bulldogged" or trapped between the two sets of opposing slip cones, which are in turn jammed under the slips. In order to release this type of a retrievable packer, the upper slip must be pulled from a position of very high engagement force between the casing and the cone which is used to guide the slip outwardly into contact with the casing. Damage can result to the tool if the slip is literally pulled off the tool, which leaves the remainder of the tool hung up in the wellbore.

In the past, various combinations of slips and cones have been used for urging the slips outwardly into contact with the casing. One such slip actuation mechanism is shown in U.S. Pat. No. 4,711,326. This patent illustrates vertically shiftable slips carried in slots by the side edges which engage mating profiles formed in the slots. These slots form guideways for the slips for shifting the slips upwardly and outwardly relative to the body between a set position for engaging a conduit and an unset position. Various other designs have used an upward pull to release the slips. Such designs are illustrated in U.S. Pat. Nos. 5,044,433 and 5,044,441.

The shortcomings of the prior designs have been in the release sequence. The prior designs have emphasized a direct pull upwardly on the uppermost slip from a mandrel to make the slips ride along the cone and retract from contact with the surrounding casing. In the prior designs, the initial contact force between the slip and the casing has been so great that shifting the mandrel to apply direct force to the slip has resulted in failure at the connection between the mandrel and the slip, leaving the slip still engaged to the casing.

The desired objective in the past has been to find a way to undermine the support for the slip so as to avoid the hazard of having to apply unduly high forces to make the slip release while under load. The apparatus and method of the present invention addresses this need to release the upper slip with a design that provides for selective weakening of the structural support for the engaged slips by virtue of components in the cone so that release can be accomplished with a greatly reduced force.

SUMMARY OF THE INVENTION

A slip release system is disclosed which undermines support for slips by virtue of selective weakening of a structural element supporting the slips in a set position.

DETAILED DESCRIPTION OF THE PREFERRED EMBODIMENT

Figure 1:
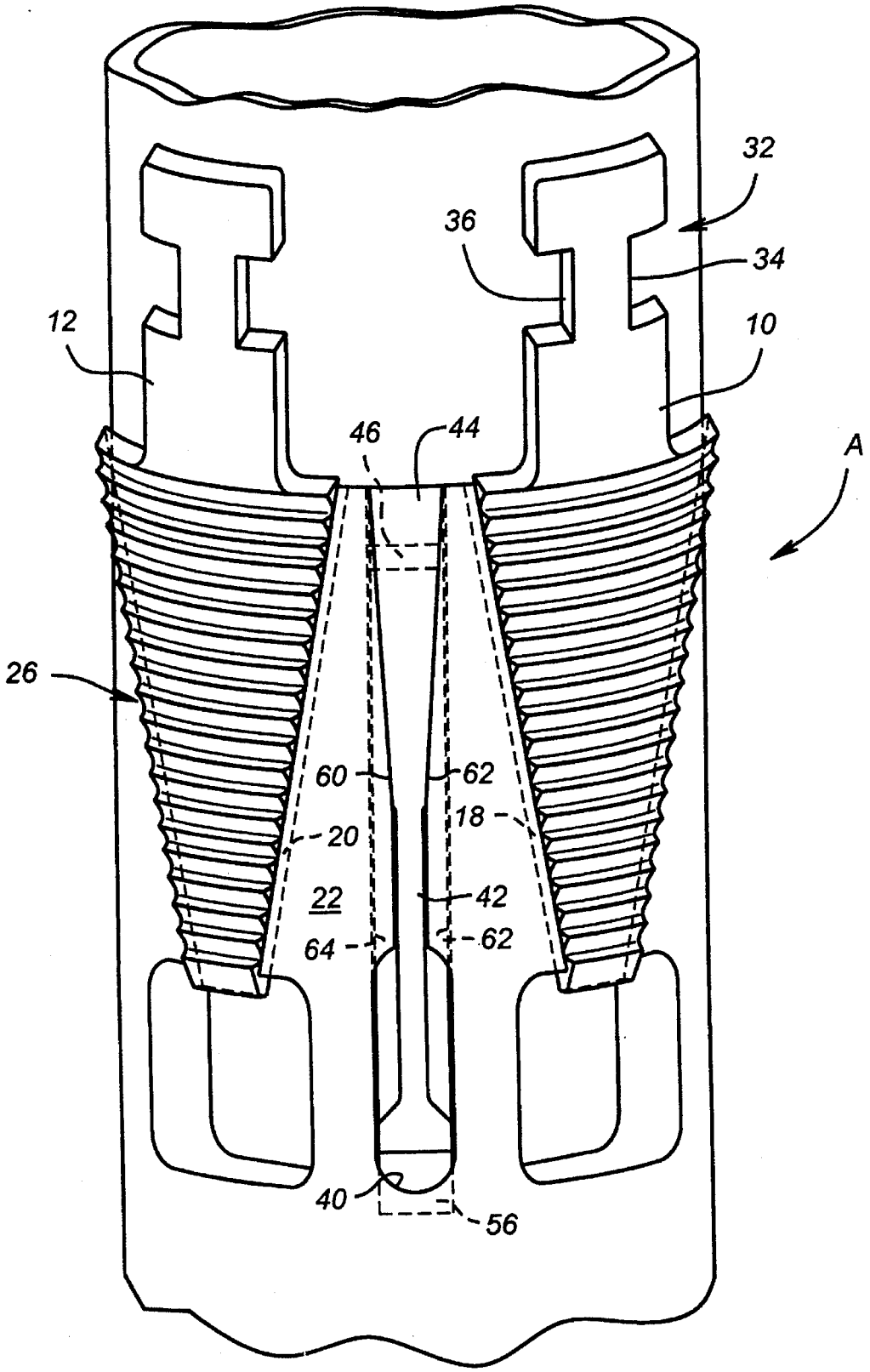
FIG. 1 is perspective of the apparatus of the present invention, shown in the set position for the slips.
Figure 2:
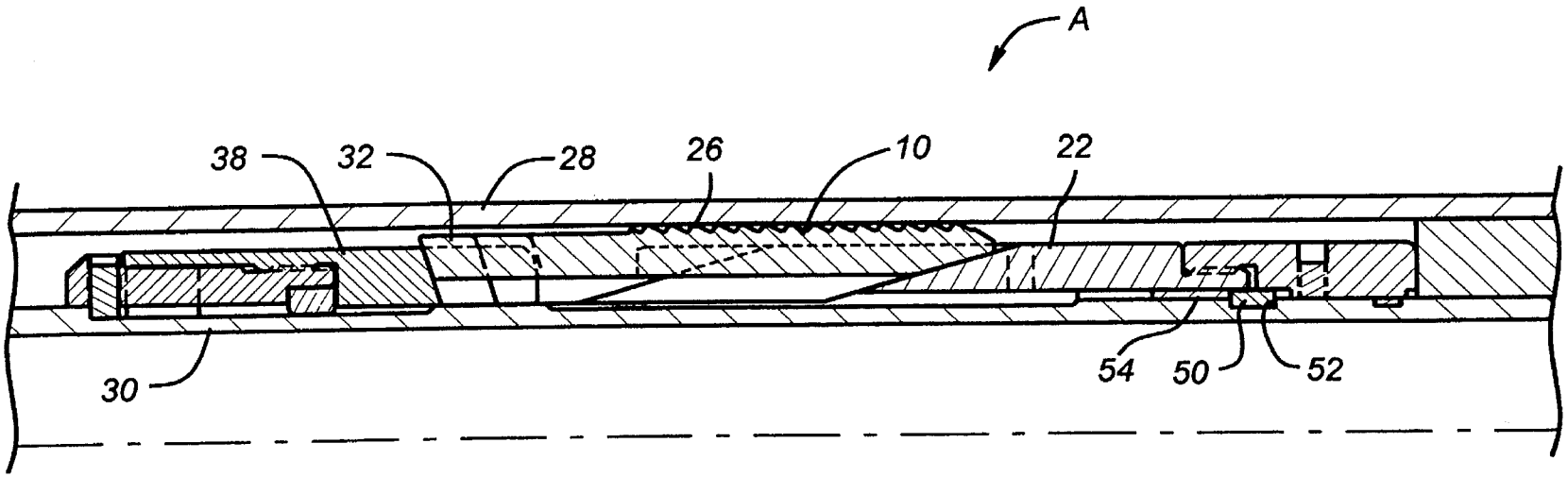
FIG. 2 is a sectional elevational view of the slips in the set position.

The apparatus A is shown in FIG. 1. There a series of slips 10 and 12 are illustrated. The slips 10 and are disposed preferably at 90° in an annularly shaped apparatus A which is suitable for downhole use when four slips are used. More or less slips can be used without departing from the spirit of the invention. Preferably, the slips 10 and 12 are identical in construction and in the preferred embodiment have opposed edges 18 and 20 which are guided by a cone 22. Cone 22 guides edges 18 and 20 in a manner so as to urge the slips 10 and 12 outwardly toward casing 28 as they move downwardly. When the slip, such as slip 10, advances along cone 22, it is outwardly ramped, as shown in FIG. 2, until the teeth 26 engage the casing 28, thereby suspending the mandrel 30. As previously stated, the assembly using slips can be used for a variety of downhole tools. One typical application is a packer assembly with the packing element secured above and below by slips, as illustrated in FIG. 1. At the top of each of the slips illustrated in FIG. 1 is a handle assembly 32, comprising of a pair of opposed recesses 34 and 36. Extending into recesses 34 and 36 to actuate the slip along edges 18 and 20 is sleeve 38, which is actuated for movement using mandrel 30. Upon downward movement of mandrel 30, sleeve 38 biases the edges 18 and 20 along cone 22.

Figure 3:
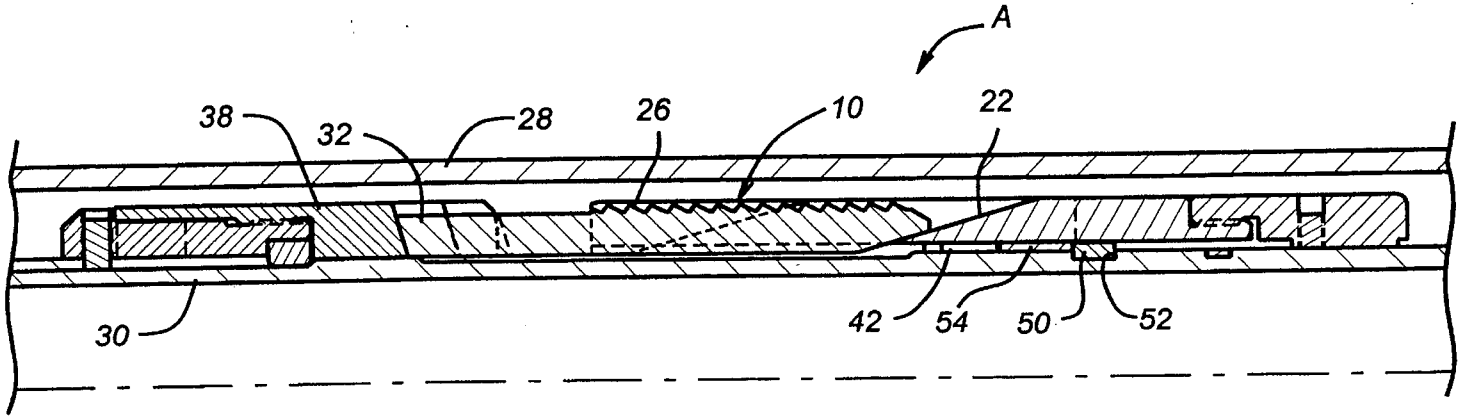
FIG. 3 is a sectional elevational view in the released position.
Figure 3A:
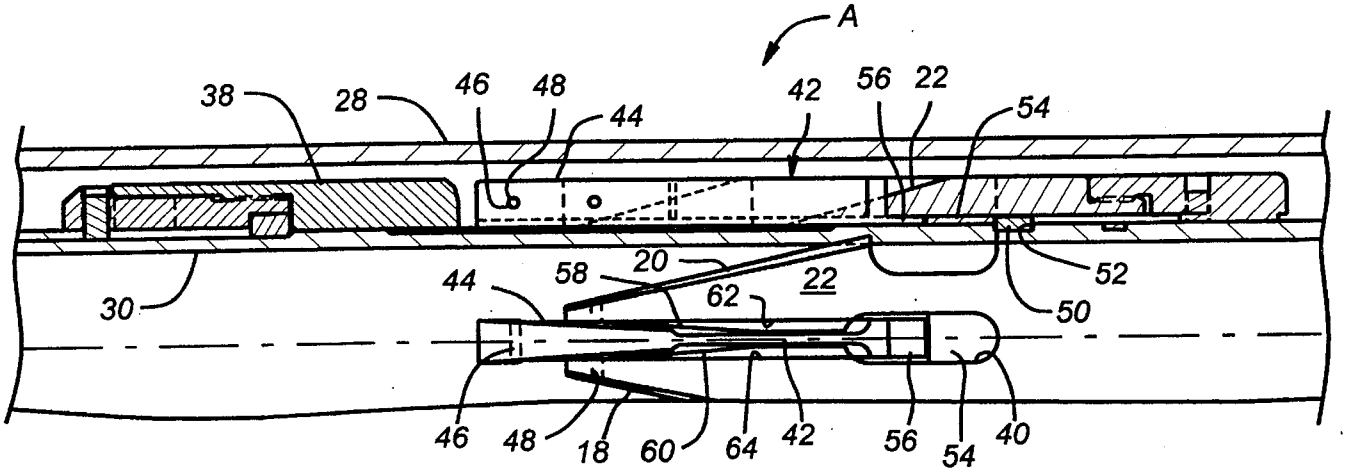
FIG. 3A is a sectional elevational view illustrating the key and cone in the released position.

FIG. 2 illustrates the slips in the set position. The walls of the cone 22 have disposed within cut-outs 40 a key 42 (as illustrated in FIG. 3A). Key 42 has a tapered upper end 44 whose position is fixed with respect to cone 22 by virtue of pin 46 extending transversely through bore 48 (see FIG. 3 and 3*a*). As will be explained below, when it is time to release the slips 10 and 12, the pin 46 is sheared with respect to bore 48 as key 42 is upwardly biased. As shown in FIGS. 2 and 3, mandrel 30 has a ring 50 secured in a groove 52. Keys 42 extend radially outwardly from cut-outs 40 such that upon upward movement of ring 50, the mandrel 30 exerts an upward force on keys 42. This is illustrated by comparing FIG. 3 to FIG. 2. As can be seen in FIGS. 3and 3A, when it is time to release the packer or tool employing the slips 10 and 12, the upper slips 10 and 12 are released by an upward pull on the mandrel 30. This upward pull brings up ring 50, which in turn via sleeve 54 pushes on lower end 56 of each of the keys 42. As keys 42 move up, pin 46, which extends through keys 42 and into cone 22, is sheared as illustrated in FIGS. 3 and 3A. Because the upper end of each of the keys 42 is tapered, the side walls 58 and 60 converge as they present themselves adjacent the top of cut-out 40 near bore 48. As a result, the circumferential support presented by cone 22 onto side walls 18 and 20 is undermined as edges 62 and 64 of cut-out 40 have the opportunity under load to flex toward each other. Once edges 62 and 64 are free to flex circumferentially toward each other, the side walls holding edges 18 and 20 can move away from each other reducing or eliminating the wedging force on slips 10 and 12, wherein an upward pull on handle 32 of the slips 10 and 12 easily dislodges teeth 26 from casing 28. Up until the time that pin 46 is sheared, the cone 22 has a rigid cylindrical structure and the slips 10 and 12 are firmly wedged along their edges 18 and 20 to the cone 22. However, with the keys 42 moved upwardly by movement of mandrel 30, the entire cone structure 22 is substantially weakened circumferentially so that the slips 10 and 12 may thereafter be easily pulled upwardly. Therefore, because of ramped guidance along edges 18 and 20, an upward pull from sleeve 38 after movement of keys 42 retracts the teeth 26 from casing 28.

The present design is a significant improvement over prior designs which have exhibited numerous problems in getting the upper slips to release. In prior designs, direct pulls on slips in the area of handle 32 in a situation where the slips are firmly wedged has frequently resulted in breakage of the handle 32. As a result, the entire top of the tool down to the slips and cones must be milled in order to be able to retrieve the tool from the wellbore and to allow the packing element (not shown) to release.

Those skilled in the art will appreciate that what has been illustrated is a specific mechanical embodiment which selectively weakens the elements used to wedge a slip in the set position. Other mechanical embodiments that weaken the cone structure so as to facilitate ultimate disengagement or defeat the wedging of the slips are also within the purview of the invention. One advantage of the design of the present invention is that the keys 42 may be reset and new pins 46 installed so that the cone 22 can be reused on another application. While a mechanical release mechanism has been illustrated, those skilled in the art will appreciate that hydraulic forces from the wellbore or from the surface alone or in combination with mechanical forces can also be used to initiate the release feature which weakens the cone structure, thereby facilitating removal of the slips in a condition where they are not mechanically or otherwise wedged against a casing 28. Other means of storing or applying a force to move keys 42 such as electrical or chemical can also be used. While a notch with a tapered wedge is illustrated as the preferred embodiment, other devices which weaken the cone wall and thus relieve, at least in part, a wedging force on the slips are within the scope of the invention.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for activating a slip for downhole use comprising:

at least one slip;

an annularly shaped slip support member having a longitudinal axis, said slip movably mounted to said slip support member for selective movement toward and away from said longitudinal axis of said slip support member; and a weakening assembly retained by said slip support member and selectively movable with respect to said slip support member while remaining retained thereby to facilitate retraction of said slip toward said longitudinal axis of said slip support member.

2. An apparatus for activating a slip for downhole use, comprising:

at least one slip;

a slip support member having a longitudinal axis, said slip movably mounted to said slip support member for selective movement toward and away from said longitudinal axis of said slip support member;

a weakening assembly on said slip support member selectively operable to facilitate retraction of said slip toward said longitudinal axis of said slip support member;

said slip support member has a wall in which said weakening assembly is mounted; and said weakening assembly selectively allowing portions of said wall to move with respect to each other thereby undermining support for said slip when it is in contact with an object and in a position away from the longitudinal axis of said slip support member.

3. The apparatus of claim 2, wherein:

said wall is formed having at least one notch;

said weakening assembly further comprises a selectively movable element in said notch; and said movable element selectively acting as a part of said wall in a first position and moving away from said wall in a second position.

4. The apparatus of claim 3, wherein:

said movable element further comprises a taper.

5. The apparatus of claim 4, wherein:

said movable element is releasably secured to said wall in a manner as to lend structural support thereto, whereupon actuation of said element, said releasably secure connection is defeated and a thinner portion of said element is positioned in said notch in place of a thicker portion of said taper thereby weakening said wall.

6. The apparatus of claim 5, further comprising:

a shear pin extending from said wall into said thicker portion of said element to hold it in position against said wall for selective structural support thereof.

7. The apparatus of claim 5, further comprising:

a downhole tool selectively securable downhole with said slip;

said tool further comprising a mandrel, operably connected to said slip and said element;

said mandrel engaging said slip for outward movement of said slip along said support member until it becomes wedged against a fixed object downhole; and said mandrel selectively moving said taper of said element away from said wall to weaken it and relieve a wedging force previously holding said slip wedged against a fixed object downhole.

8. The apparatus of claim 7, further comprising:

a plurality of slips mounted to said slip support member;

a packing element mounted to said mandrel below said slip support member;

whereupon actuation of said mandrel extends said packing element in the wellbore to seal it and wedges said slips between said support member and the wellbore.

9. The apparatus of claim 8, wherein:

said mandrel moves said element to weaken said wall before applying a force on said slips to retract them along said support member in a direction toward its longitudinal axis.

10. A method of releasing a slip from a set position where it is wedged between a support member and a casing or liner, comprising:

providing a weakening assembly retained by the support member;

moving the weakening assembly with respect to the support member while continuing to retain said weakening assembly thereto;

weakening a wall in said support member by said moving; and retracting the slip from the casing or wellbore.

11. A method of releasing a slip from a set position where it is wedged between a support member and a casing or liner, comprising:

providing a weakening assembly in the support member;

providing as a part of said weakening assembly at least one notch in the wall of said support member;

providing a movable element in said notch;

actuating the weakening assembly to weaken a wall in said support member;

selectively positioning said element to allow opposed forces of said notch to move with respect to each other as a result of said actuating step;

retracting the slip from the casing or wellbore.

12. The method of claim 11, further comprising the steps of:

providing a taper in said element;

releasably securing a thick portion of said taper in said notch for spanning said notch for structural support thereof;

moving said thick portion with respect to said notch;

placing a thin portion of said element in said notch in place of said thick portion;

allowing said opposed faces of said notch to flex toward said thin portion; and releasing, at least in part, wedging forces on said slip from said flexing.

13. The method of claim 12, further comprising the steps of:

providing a mandrel for support of said support member and actuation of the slip;

moving the mandrel into contact with said element;

shifting said element with said mandrel;

weakening said wall with said shifting; and retracting the slip with said mandrel after said weakening.

14. The method of claim 13, further comprising the steps of:

providing a plurality of slips mounted to said support member;

providing at least one of said notches between at least one pair of slips; and setting said slips by moving said mandrel against said slips.

15. The method of claim 14, further comprising the steps of:

providing a packing element on said mandrel; and moving said mandrel selectively to set said packing element.

16. A release mechanism for an uppermost slip assembly used to selectively retain a removable downhole tool against a liner or casing comprising:

a cone having a wall and movably supporting a plurality of slips;

a movable wall member movably retained in said cone wall between a first and second position and selectively operable to provide wall support in said first position and no wall support in said second position; and whereupon actuation of said wall member, circumferential flexing of portions of said cone wall with respect to said wall member relieves a wedging force on said slips, facilitating their retraction from the casing or liner.

17. The apparatus of claim 16, further comprising:

a mandrel, said mandrel acting on said slips to set them against the casing or liner and to retract said slips after it moves said movable wall member to its second said position.

18. A release mechanism for an uppermost slip assembly used to selectively retain a removeable downhole tool against a liner or casing, comprising:

a cone having a wall and movably supporting a plurality of slips;

a movable wall member in said cone wall selectively operable to provide wall support in a first position and no wall support in a second position; and whereupon actuation of said wall member, flexing of portions of said cone wall with respect to said wall member relieves a wedging force on said slips, facilitating their retraction from the casing or liner;

a mandrel, said mandrel acting on said slips to set them against the casing or liner and to retract said slips after it moves said movable wall member to its second said position;

said movable wall member is a tapered element disposed in a notch in said cone wall;

said tapered element having a thick portion which spans said notch and is releasably secured for structural support of said wall of said cone, with said thick segment spanning said notch; and said mandrel selectively overcoming the securing forces on said tapered element and shifting it so a thinner portion is disposed in said notch.

19. The apparatus of claim 18, wherein:

said thick portion is releasably secured to said notch by a shear pin.

20. The apparatus of claim 17, further comprising:

hydraulic activating means for moving said wall member to remove wall support in said cone for said slips.

* * * * *